United States Patent [19]

Masaki et al.

[11] 4,456,362

[45] Jun. 26, 1984

[54] PORTABLE IMAGE FORMING APPARATUS

[75] Inventors: Nobuo Masaki, Tokyo; Hiroyuki Tokuda, Kawasaki; Yoshiki Furukawa, Tokyo; Mitsuru Sakurai, Musashino; Hiroshi Nitanda, Tokyo, all of Japan

[73] Assignee: Canon Kabushiki Kaisha, Tokyo, Japan

[21] Appl. No.: 342,366

[22] Filed: Jan. 25, 1982

[30] Foreign Application Priority Data

Feb. 5, 1981 [JP] Japan ..... 56-15131[U]

[51] Int. Cl.[3] ..... G03G 15/00

[52] U.S. Cl. ..... 355/3 R; 355/3 SH; 355/14 SH; 355/21; 355/72; 294/138; 294/139; 294/141

[58] Field of Search ..... 355/3 SH, 14 SH, 3 R, 355/21, 72–74; 294/137, 138, 139, 140, 141, 143, 144, 158; 312/140.2, 253, 270, DIG. 33

[56] References Cited

U.S. PATENT DOCUMENTS

| | | | |
|---|---|---|---|
| 1,136,598 | 4/1915 | Gould | 294/138 |
| 1,373,136 | 3/1921 | Kranz | 294/138 |
| 2,481,106 | 9/1949 | Gold | 294/139 |
| 2,493,182 | 1/1950 | Beder | 294/138 X |
| 2,494,077 | 1/1950 | Wilkinson | 355/74 X |
| 2,494,495 | 1/1950 | Tait et al. | 355/21 |
| 2,699,088 | 1/1955 | Hedrick | 355/21 |
| 3,286,589 | 11/1966 | Glidden | 355/21 |
| 4,191,467 | 3/1980 | Schieck | 355/72 X |
| 4,365,733 | 12/1982 | McNew | 355/72 X |

*Primary Examiner*—A. C. Prescott

*Attorney, Agent, or Firm*—Fitzpatrick, Cella, Harper & Scinto

[57] ABSTRACT

In a portable type machine, material supporting members adapted to be stretched for use during the use of the machine are pivotally connected to the opposite sides of the machine for upward rotation and during the transportation of the machine, the supporting members are pivoted onto the top of the machine body so as to form a transportation handle on top of the machine body. By one touch, the machine can be transformed from its shape during use into a compact shape suitable for transportation, thus greatly enhancing the transportation efficiency of the machine.

5 Claims, 5 Drawing Figures

PORTABLE IMAGE FORMING APPARATUS

BACKGROUND OF THE INVENTION

1. Field of the Invention

This invention relates to a transportation handle device of a portable type machine.

2. Description of the Prior Art

Portable type machines such as electrophotographic copying apparatus have been provided with supporting members for supporting paper or an original thereon, for example, a paper discharge table and a paper feed table. These supporting members are fixedly or removably mounted to the machine body. Therefore, when the machine body is to be transported, a large space has been required. Otherwise, the problem of separating the supporting members from the machine body has been encountered and thus, any of these machines have had poor transportation efficiency.

SUMMARY OF THE INVENTION

It is an object of the present invention to provide a portable type machine which can be efficiently transported.

It is another object of the present invention to provide a portable type machine in which supporting members for supporting thereon a material used with the machine can form a transportation handle.

It is still another object of the present invention to provide a portable type machine in which the supporting members can form a transportation handle so as to enable the machine to be carried in one hand.

In view of such objects, in the portable type machine of the present invention, supporting members adapted to be stretched for use during the use of the machine are pivotably provided on the opposite sides of the machine body and during transportation of the machine, the supporting members may be pivoted onto the top of the machine body so as to form a transportation handle.

The invention will become more fully apparent from the following detailed description thereof taken in conjunction with the accompanying drawings.

DESCRIPTION OF THE PREFERRED EMBODIMENT

Figure 1:
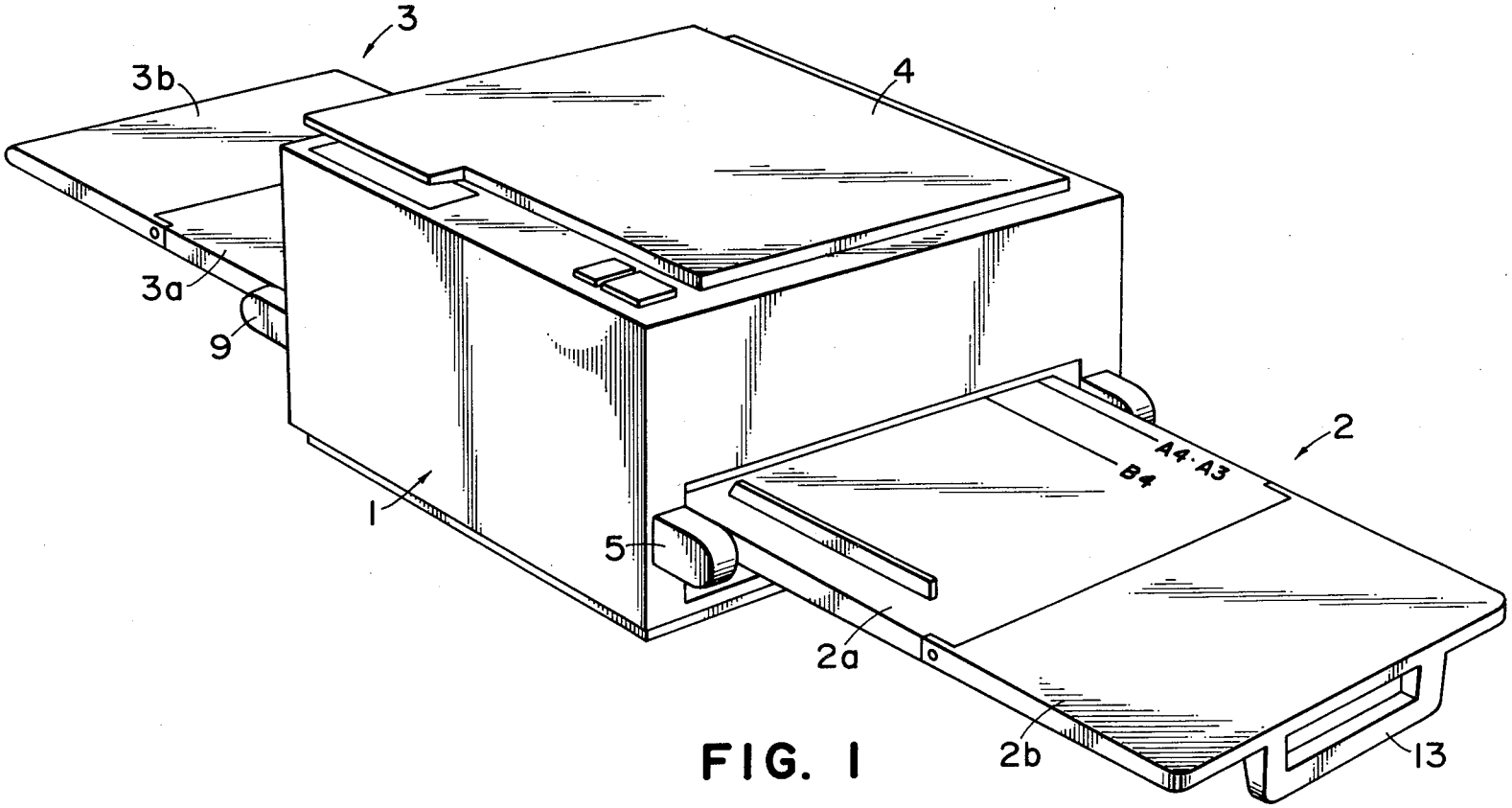
FIG. 1 is a perspective view of an embodiment of the present invention as applied to an electrophotographic copying apparatus and showing the positions of a paper discharge table and a paper feed table during copying.

The present invention will hereinafter be described with respect to an embodiment thereof applied to an electrophotographic copying apparatus and by reference to FIGS. 1 to 3. In the drawings, reference numeral 1 designates the machine body of an electrophotographic copying apparatus, and reference numerals 2 and 3 denote plate-like members disposed on the opposite sides of the machine body and used as tables for supporting materials thereon during the use of the machine. In the illustrated embodiment, reference numeral 2 designates a paper feed table and reference numeral 3 denotes a paper discharge table. A pressure plate 4 for pressing and holding an original is provided on top of the machine body 1. During copying, copy paper is placed on the paper feed table 2 and fed into the machine body 1, and after the copying is completed, the copy paper is discharged onto the paper discharge table 3.

In the illustrated embodiment, the paper feed table 2 is pivotally connected to one side of the machine body for upward rotation by means of a rotary shaft 6 (see FIG. 3) supported by a bearing 5 projectedly provided on the one side of the machine body. A paper feed table rotation stop 7 is provided near the paper feed port of the machine body 1 so as to enable the paper feed table 2 to be held at an angle for optimally satisfying the copying function during the use of the copying apparatus, and is adapted to bear against a pawl 8 provided at the extension of the paper feed table. Likewise, the paper discharge table 3 is pivotally connected to the other side of the machine body 1 for upward rotation by means of a rotary shaft (not shown) supported by a bearing 9 projectedly provided on said other side of the machine body, and is designed to be held at an angle for the paper discharge table to optimally satisfy the copying function relative to the machine body during the use of the copying apparatus.

The paper feed table 2 and the paper discharge table 3 are constructed so as to be folded onto the top of the machine body 1 and abut against each other on the top of the machine body.

In the present embodiment, the paper feed table 2 comprises two members **2*a* and 2*b* and the paper discharge table 3 comprises two members 3*a* and 3*b*. In the illustrated example, the paper feed table and the paper discharge table are entirely identical in construction and therefore, only the construction of the paper feed table 2 will hereinafter be described. The two members 2*a* and 2*b* of the paper feed table 2 are connected together so as to be bendable by a rotary shaft 10. A rotation stop 11 is provided on the outer side of the inner member 2*a*, and a pawl 12 provided on the outer member 2*b* is adapted to bear against the rotation stop 11 to thereby hold the outer member 2*b*** of the paper feed table at a predetermined angle.

Provided on the ends of the paper feed table 2 and the paper discharge table 3 are handle forming portions 13 and 14 which, when these tables are made to abut against each other on top of the machine body, cooperate with each other to form a transportation handle. These handle forming portions 13 and 14 may be constructed so as to provide bases for supporting the paper feed table 2 and the paper discharge table 3 on a supporting surface when these tables are stretched on the opposite sides of the machine body with the machine body placed on said supporting surface.

In the electrophotographic copying apparatus of the above-described embodiment, if, during the use of the machine, the paper feed table 2 and the paper discharge table 3 are stretched laterally of the machine body in the manner as shown in FIG. 1, the paper feed table and the paper discharge table will be held at their proper positions and maintained at an angle for optimally satisfying the copying function.

Figure 2:
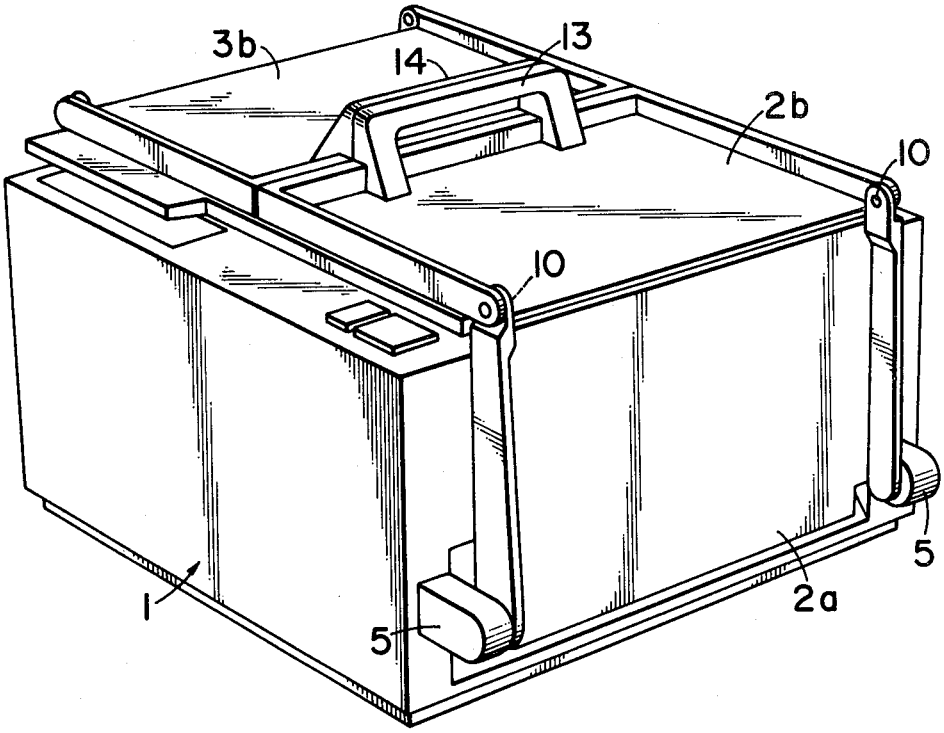
FIG. 2 is a perspective view showing the condition of the FIG. 1 elelectrophotographic copying apparatus during its transportation.
Figure 3A:
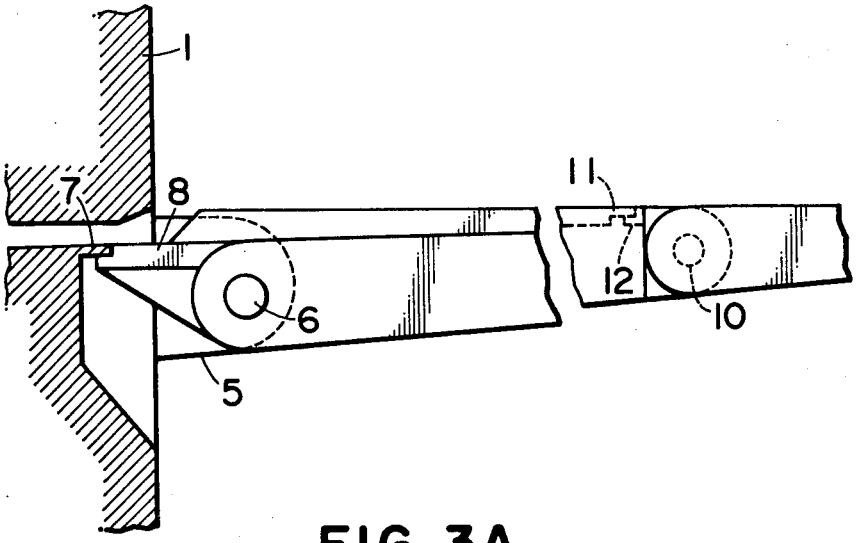
FIGS. 3A, 3B and 3C illustrate a mechanism for rotation of the paper feed table.
Figure 3B:
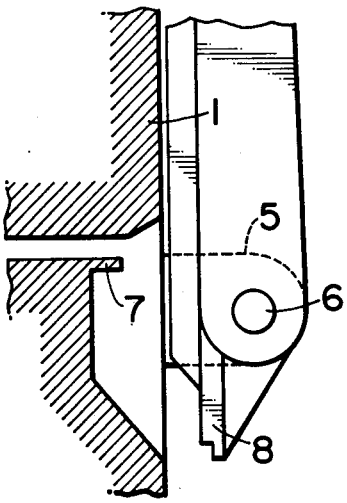
Figure 3C:
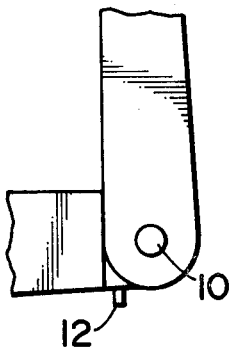

During transportation, the paper feed table and the paper discharge table may be bent upwardly in the manner as shown in FIG. 2, whereby they serve as a cover for protecting at least three sides of the machine body while overlapping the pressure plate 4, and one can carry the apparatus by gripping the handle formed by the handle forming portions 13 and 14. One can carry the apparatus in good balance by grasping the handle forming portions 13 and 14 in one hand and therefore, the machine body never inadvertently inclined and thus, leaning or scattering of the developer in the copying apparatus body can be prevented.

We claim:

1. A portable image forming apparatus comprising:

a body portion of the apparatus;

sheet holding members projecting from said body portion for holding sheet material thereon;

supporting means for pivotally supporting said sheet-holding members on said body portion, wherein said sheet holding members are pivotally movable between a storage position and an open sheet-holding position; and handle members provided on said sheet-holding members for enabling transportation of the body of the apparatus when said sheet-holding members are pivoted to their said storage position.

2. A portable image forming apparatus, comprising:

a body portion of the apparatus;

foldable sheet-holding members projecting from said body of the apparatus for receiving sheet material thereon; and supporting means for supporting said sheet-holding members for movement from an open sheet-holding position, to a closed transporting position in which said sheet-holding members conform to the contour of said body portion of the apparatus.

3. A portable image forming apparatus according to claim 1 or 2, wherein at least one of said sheet-holding members is a paper feed carriage for holding thereon papers to be fed to said body of the apparatus.

4. A portable type image forming apparatus according to claim 1 wherein at least one of said sheet-holding members is a paper discharge carriage for receiving papers discharged from said body portion of the apparatus.

5. A portable type image forming apparatus according to claim 2 wherein at least one of said sheet-holding members is a paper discharge carriage for receiving papers discharged from said body portion of the apparatus.

* * * * *